US005467840A

United States Patent [19]

Becher et al.

[11] Patent Number: 5,467,840

[45] Date of Patent: Nov. 21, 1995

[54] DRIVE UNIT FOR MOVEMENT OF TELESCOPIC SEATING SYSTEM

[75] Inventors: Mark Becher, Greer; Kenneth R. Charron, Liberty, both of S.C.

[73] Assignee: Charron Sports Services, Inc., Liberty, S.C.

[21] Appl. No.: 109,151

[22] Filed: Aug. 18, 1993

[51] Int. Cl.[6] ..... B60K 17/342; E04H 3/12

[52] U.S. Cl. ..... 180/251; 180/65.1; 180/220; 52/10

[58] Field of Search ..... 180/9.22, 24.11, 180/242, 251, 220; 52/10; 280/47.34, 47.18, 43, 43.12, 47.35

[56] References Cited

U.S. PATENT DOCUMENTS

| | | | |
|---|---|---|---|
| 3,052,929 | 9/1962 | Busse | 52/10 |
| 3,282,363 | 11/1966 | Curra | 180/9.22 |
| 3,748,798 | 7/1973 | Mackintosh | 52/10 |
| 3,872,943 | 3/1975 | Olson | 180/251 |
| 4,285,172 | 8/1981 | Quigley | 52/10 |
| 5,228,716 | 7/1993 | Dahl | 280/47.18 |

*Primary Examiner*—Margaret A. Focarino
*Assistant Examiner*—Carla Mattix
*Attorney, Agent, or Firm*—Hardaway Law Firm

[57] ABSTRACT

A drive unit (10) is provided for extending or retracting a telescopic seating system and includes a frame (14) into which a front axle (24) and a rear axle (26) are journaled, a plurality of transversely spaced wheels (28) mounted on the front axle (24) and on the rear axle (26), drive means supported by the frame (14) for imparting rotation to the axles, preferably powered by a reversible electric motor (32), and a mounting assembly temporarily attaching the drive unit (10) to a row (92) of the telescopic seating system, the mounting assembly preferably including upright connectors (80, 82, 84, 86) fastened to the row (92) proximate their upper ends and fixed at their lower ends to longitudinal beams (76, 78) detachably interconnected to the frame (14) through threaded spacers (66). The unit (10) may be additionally provided with weight support brackets (94) supporting an external weight (122) to increase traction between the wheels (28) and a floor upon which the unit (10) travels.

3 Claims, 3 Drawing Sheets

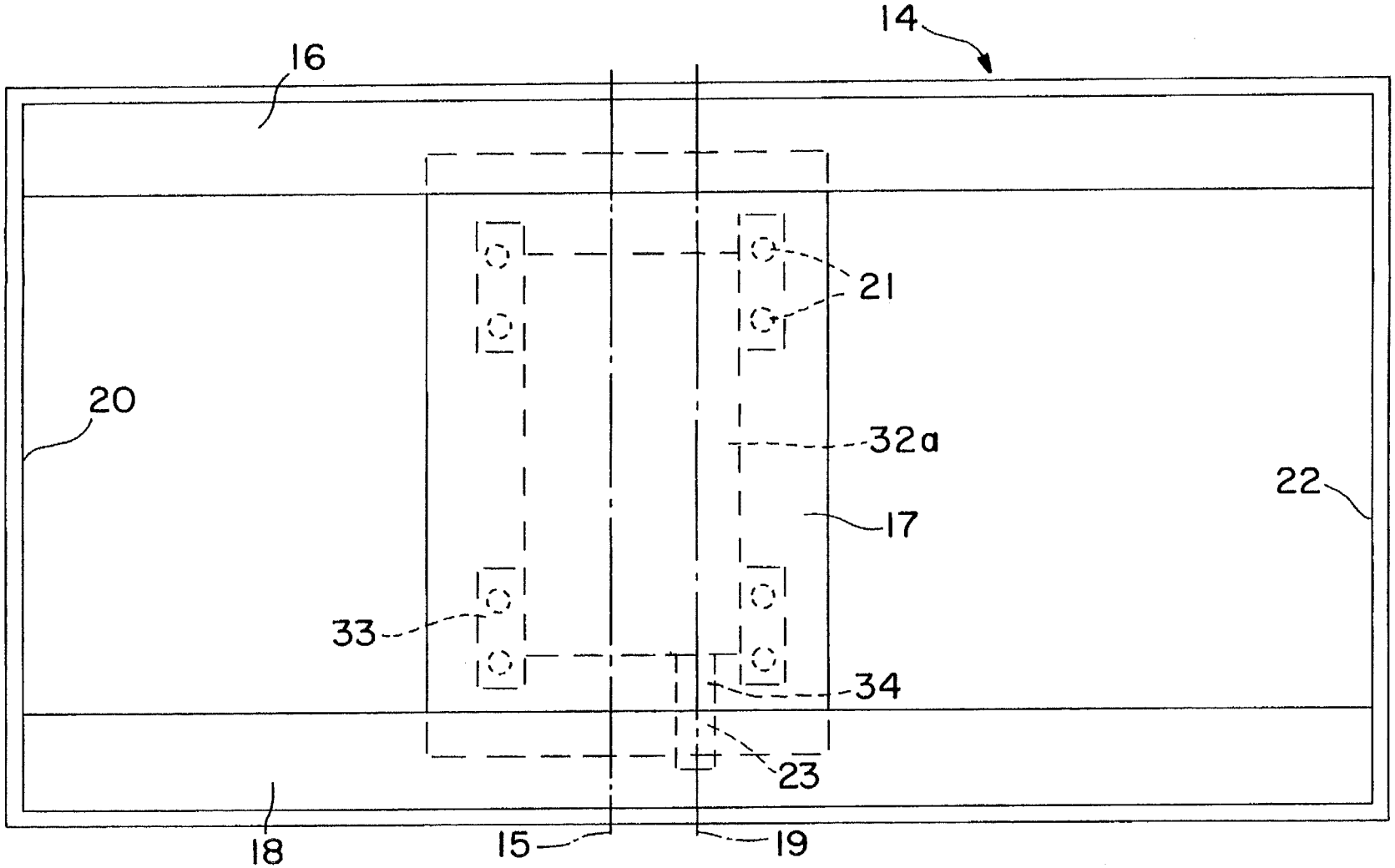
FIG. 1-A

DRIVE UNIT FOR MOVEMENT OF TELESCOPIC SEATING SYSTEM

BACKGROUND OF THE INVENTION

This invention relates to a drive unit for folding or unfolding rows of seats or benches arranged in a telescopic seating system.

Various devices are known in the art for extending or retracting bleachers, such as may be found in an indoor athletic facility. U.S. Pat. No. 4,285,172 to Quigley teaches a powered drive apparatus which folds and unfolds rows of bleachers and which is adapted to fit almost entirely beneath a deck of the lowermost row. A roller, defined therein as having an axial dimension larger than its radius, is provided at central portions of a front and a rear of a frame, each roller extending on respective axles transverse to the direction in which bleachers are moved by the apparatus. U.S. Pat. No. 3,282,363 to Curra discloses a tractor means for extending and retracting bleacher stand sections. The tractor means includes a frame into which a drive for tread members is centrally mounted. Wheels, provided at each corner of the tractor means, are normally spaced from the floor during operation of the tractor means. U.S. Pat. No. 3,872,943 to Olson, although not disclosing an apparatus used for moving bleacher rows, teaches a drive unit for transporting pipe sections wherein wheels at each corner of a supported frame contact the ground.

While the foregoing devices may be deemed suitable for their respective intended purposes, room for improvement still exists in the art.

SUMMARY OF THE INVENTION

It is an important object of the present invention to provide a drive unit which imparts movement to rows in a telescopic seating system in an efficient manner.

It is a further object of the present invention to provide a drive unit which allows for placement of weights thereupon so as to ensure traction between the unit and a floor upon which it travels.

It is a further object of the present invention to provide a drive unit which is attachable to telescopic seating systems of varying configurations.

These as well as other objects are accomplished by a drive unit for extending and retracting a telescopic seating system, comprising a frame into which a front axle and a rear axle are journaled, a plurality of transversely spaced wheels mounted on the front and rear axles, drive means supported by the frame for imparting rotation to the front axle and to the rear axle; and mounting means for temporarily attaching the drive unit to a lowermost row of the telescopic seating system.

BRIEF DESCRIPTION OF THE DRAWINGS

FIG. 1A is a plan view of a bare frame of the drive unit illustrated in FIG. 1, showing a motor in phantom lines mounted upon a mounting plate of the frame.

DETAILED DESCRIPTION

In accordance with this invention, it has been found that a drive unit for movement of telescopic seating systems may be provided wherein a frame is supported by a plurality of transversely spaced wheels mounted on front and rear axles driven by a drive means mounted in the frame intermediate the front and rear axles.

Figure 1:
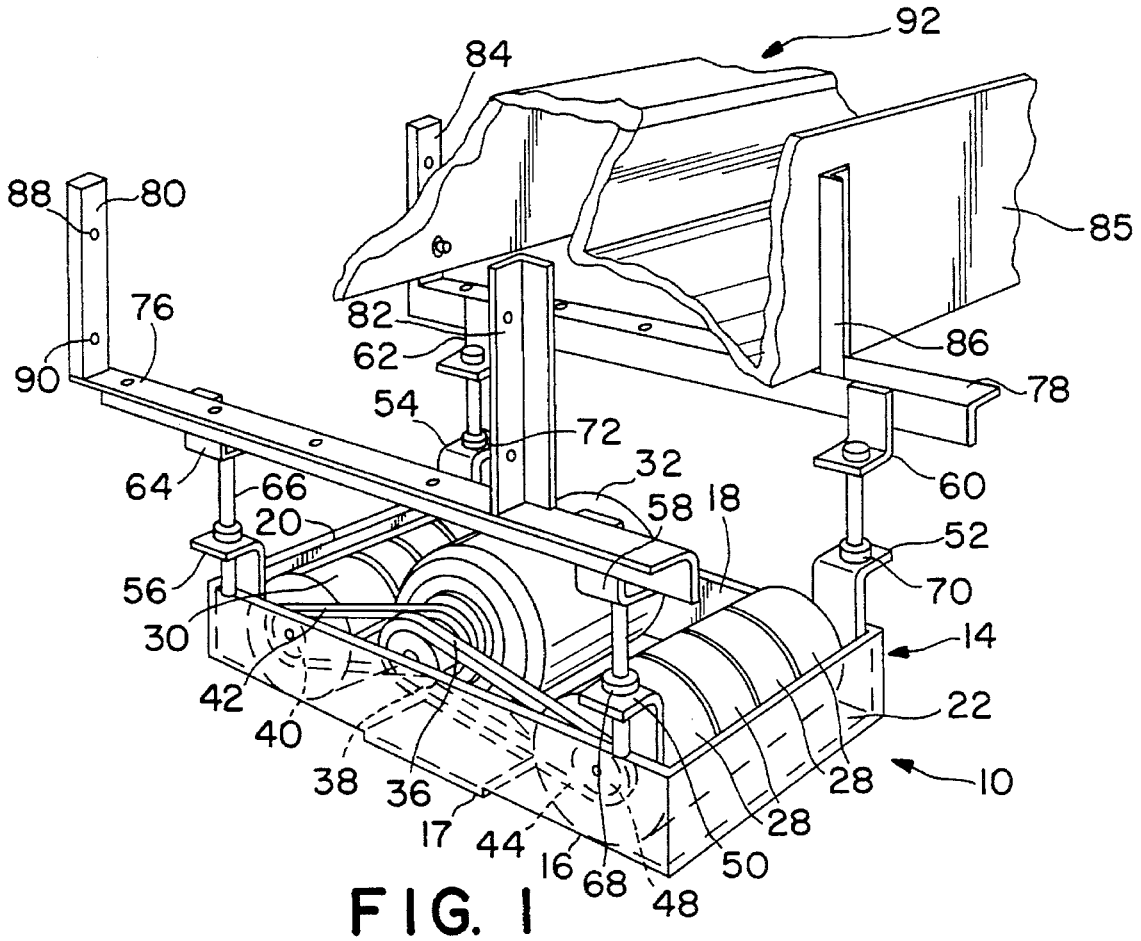
FIG. 1 is a perspective view of a drive unit constructed in accordance with a preferred embodiment of the present invention, shown in association with a lowermost row of a telescopic seating system to which the drive unit is attached.
Figure 2:
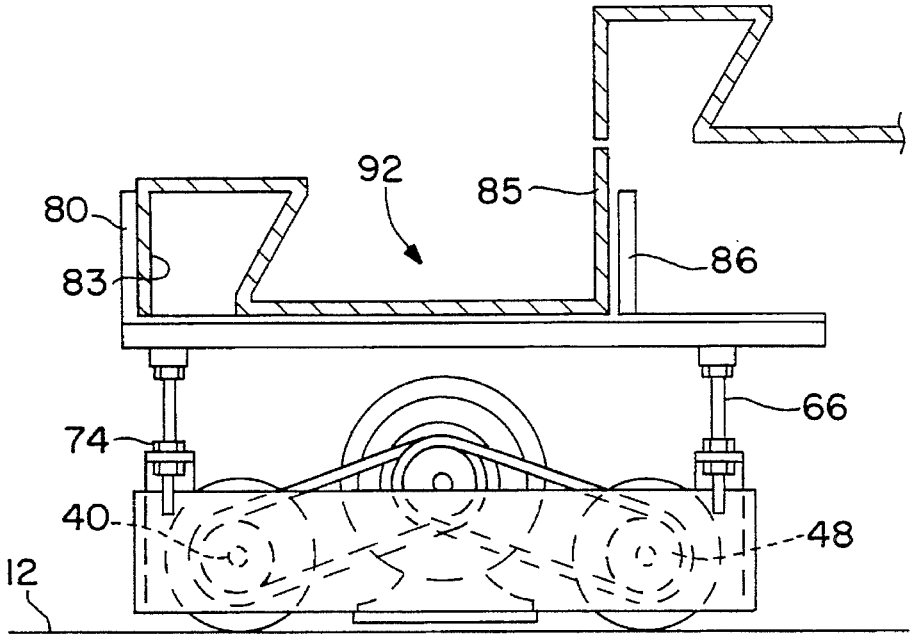
FIG. 2 is a side elevation view of the drive unit illustrated in FIG. 1.
Figure 3:
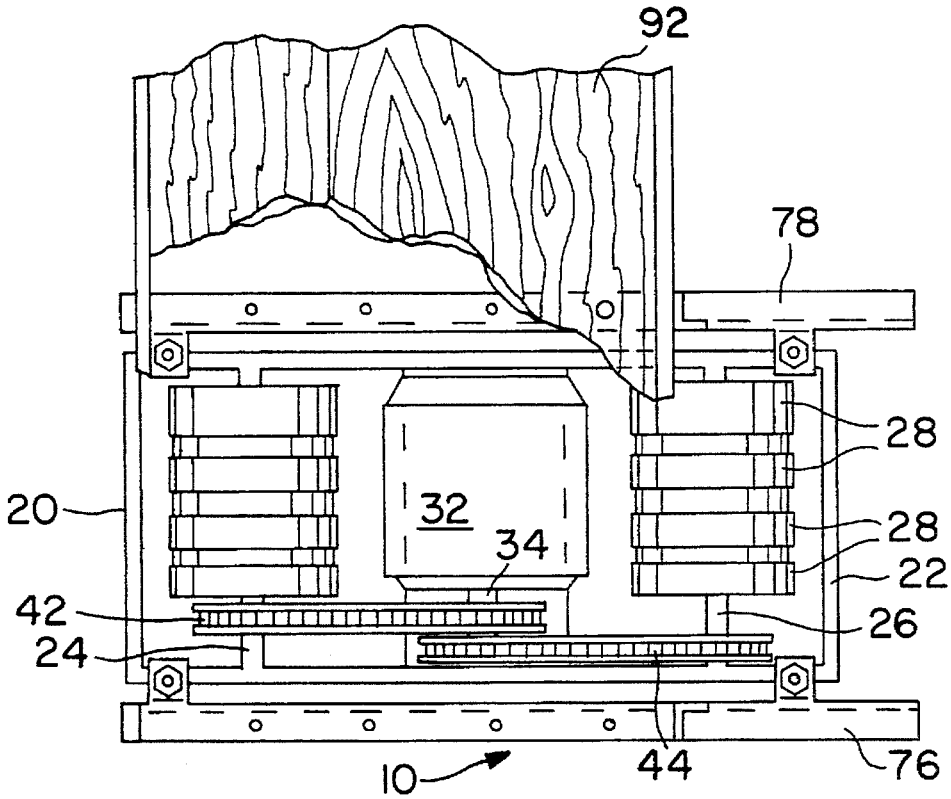
FIG. 3 is a plan view of the drive unit illustrated in FIG. 1.

FIGS. 1–3 illustrate a drive unit 10 including a frame 14 comprised of longitudinal members 16 and 18, a front transverse panel 20, and a rear transverse panel 22. Members 16, 18 are preferably angle sections, although other section shapes are contemplated as being within the scope of the present invention. Panels 20, 22 are preferably attached to ends of the longitudinal members 16, 18 by welding.

As best seen in FIG. 1A, a support plate 17 is attached to the undersides of the longitudinal members 16, 18 of the frame 14 for supporting a drive means, such as an electric motor. A centerline 15 of support plate 17 is preferably offset frontwardly of a transverse centerline 19 of the frame 14. The offset compensates for the offset of an axis 23 of motor drive shaft 34 from a longitudinal axis of the motor housing 32*a*, enabling axis 23 to coincide with centerline 19, thereby allowing identical lengths of means interconnecting the motor to both front and rear axles, said means and said axles to be more fully described herein. A plurality of apertures 21 are formed into the support plate 17 in order to accommodate an electric motor 32 such that it may sit upon the support plate 17 in an upright, as opposed to an inverted, orientation. This promotes ease in motor installation and in any necessary motor replacement. Fasteners extend through apertures in motor support brackets 33 and apertures 21 to secure the motor 32 to the support plate 17. The support plate 17 imparts structural integrity to the frame 14 in enhancing its rigidity.

Apertures are formed into the longitudinal panels 16, 18 proximate each of their respective ends to accommodate a front axle 24 and a rear axle 26. A plurality of transversely spaced wheels 28, mounted on the axles 24, 26, elevates the frame 14 above the floor 12. The term "wheel" as used herein is defined as a cylindrical member having a radius greater than its axial dimension. It has been found that wheels are more readily available from manufacturers than are rollers such as those used in a drive unit of the prior art. As illustrated in the figures, the preferred embodiment of the present invention employs four (4) wheels on each axle, with a space between the two inside wheels of an axle being larger than the remaining spaces between wheels, preferably exceeding these spaces by about one inch. Each wheel 28 has a coating 30 of high friction material to enhance bearing friction between each wheel 28 and the floor 12. Optimum thickness and material for coating 30 has been found to be a ⅞ -inch coating of rubber.

An electric motor 32 is attached to support plate 17 for imparting rotation to the front axle 24 and to the rear axle 26. Such a motor is preferably a Model No. 5K934 motor manufactured by W. W. Grainger Co. of Chicago, Ill., the motor 32 being modified to impart reversibility thereto. A drive shaft 34, communicating with and rotatably driven by the motor 32, carries first and second drive sprockets 36 and 38, respectively. Front axle 24 is provided with a front sprocket 40 which, together with first drive sprocket 36, supports a first endless chain 42. Similarly, a second endless chain 44 is supported by the second drive sprocket 38 and a rear sprocket 48 mounted on rear axle 26. Through this arrangement, the motor 32 drives both front axle 24 and rear axle 26.

Proximate each corner of the frame 14, angled frame tabs 50, 52, 54, 56 are fixed to the upper edges of the longitudinal members 16 and 18 and are oriented such that their horizontal legs project outwardly of the frame 14. Horizontal legs of upper angled tabs 58, 60, 62, 64 are oppositely oriented and are interconnected to associated lower angled supports 50, 52, 54, 56 through threaded spacers 66 secured by nuts 68, 70, 72, 74. A longitudinal beam 76 is welded to the outer faces of the vertical legs of upper angled tabs 58 and 64. Another such beam, connected in the same manner to upper angled tabs 60 and 62, is shown at 78. Upright connectors 80, 82, and 84, 86, preferably constructed of angle sections, are welded at their lower ends to the upper surfaces of longitudinal beams 76 and 78, respectively. Apertures such as shown at 88 and 90 are formed into upright connectors 80, 82 and 84, 86 for temporary attachment to a lowermost row 92 of a telescopic seating system.

Referring to FIG. 2, front upright connector 80 and rear upright connector 86 are shown attached to a front panel 83 and a riser 85, respectively, of lowermost bleacher row 92.

It is to be noted that the combination of the upper angled tabs 58, 60, 62, 64, the longitudinal beams 76, 78, and the upright connectors 80, 82, 84, 86 forms a mounting assembly which is detachable from the frame at the angled frame tabs 50, 52, 54, 56. Mounting assemblies of differing sizes and arrangements are contemplated as being within the scope of the present invention. For instance, where a particular bleacher configuration requires a narrower front elevation of the unit 10, the longitudinal beams 76 and 78 may be transposed from their illustrated positions such that the horizontal legs of upper angled tabs 58, 64 and 60, 62, associated with beams 76 and 78, respectively, point inwardly of the frame 14. Thus, the same design of unit 10 may be attached to many types of bleachers.

The unit 10 is preferably provided with external weights which increase the traction between the wheels 28 and a floor. Moreover, external weights impart increased inertial force to the unit 10 once it begins moving, thus making it progressively easier for the unit 10 to extend or fold each sequential bleacher row.

Figure 4:
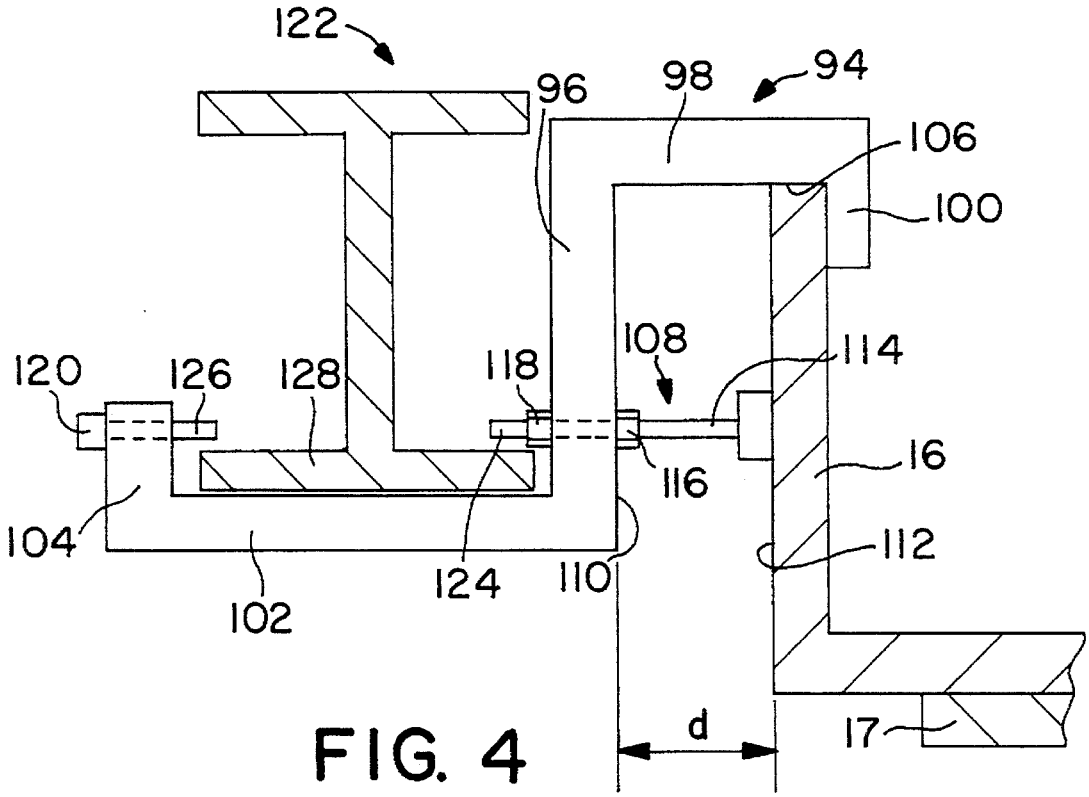
FIG. 4 is a sectional elevation view of a longitudinal member carrying a weight support bracket with a weight thereon.

Referring now to FIG. 4, weight support brackets such as at 94 may be carried by each longitudinal member of frame 14, here member 16. The weight support bracket 94 is preferably constructed of a 1½-inch wide, ¾- to ⅞-inch thick steel bar bent as shown to form a vertical section 96, an upper horizontal section 98 extending from a top portion of the vertical section 96, a first lip 100 extending downwardly from a terminal portion of the upper horizontal section 98, a lower horizontal section 102 extending from a lower portion of vertical section 96, and a second lip 104 extending upwardly from a terminal portion of the lower horizontal section 102.

Upper horizontal section 98 and first lip 100 form a hook to engage an edge 106 of the longitudinal member 16. A spacer assembly 108 maintains a desired distance "d" between inside face 110 of vertical section 96 and the outside face 112 of longitudinal member 16. The spacer assembly is preferably comprised of a threaded fastener 114 and bearing nuts 116, 118, thereby allowing distance "d" to be adjusted as desired. Additionally, a second threaded fastener 120 extends transversely through second lip 104. A weight 122, preferably an I-beam readily available from scrap railroad rails, is placed onto the lower horizontal section 102 of the bracket 94. Threaded fasteners 114, 120 are then adjusted so that their respective ends 124, 126 extend over portions of a lower web 128 of the weight 122 to secure it in place on the lower horizontal section 102.

The preferred embodiment contemplates that two weight support brackets 94 be provided for each longitudinal member 16, 18, and that each weight 122 weigh approximately 45 lbs. and be 24" long, 5–6" wide, and 8–10" high.

It is thus seen that an improved friction drive unit may be provided which is simpler to construct than other such devices heretofore known and which can be readily mounted to a wide variety of bleachers.

As the above description is merely exemplary in nature, being merely illustrative of the invention, many variations will become apparent to those of skill in the art. Such variations, however, are included within the spirit and scope of this invention as defined by the following appended claims.

That which is claimed:

1. A drive unit for extending and retracting a telescopic seating system, comprising:

a frame;

a front axle journaled into said frame;

a rear axle journaled into said frame;

a plurality of transversely spaced wheels mounted on said front axle and said rear axle;

drive means supported by said frame for imparting rotation to said front axle and to said rear axle;

a mounting assembly for temporarily attaching said drive unit to a lowermost row of said telescopic seating system, said mounting assembly being detachably mounted to said frame;

a weight support bracket carried by said frame, said weight support bracket comprising a vertical section, an upper horizontal section extending from a top portion of said vertical section, a first lip extending downwardly from a terminal portion of said upper horizontal section, a lower horizontal section extending from a lower portion of said vertical section, and a second lip extending upwardly from a terminal portion of said lower horizontal section; and a weight carried by said weight support bracket for increasing traction between said plurality of wheels and a floor upon which said drive unit travels.

2. The drive unit set forth in claim 1 further comprising a spacer assembly spacing said vertical portion of said weight support bracket from said frame.

3. A drive unit for extending and retracting a telescopic seating system, comprising:

a frame;

a front axle journaled into said frame;

a rear axle journaled into said frame;

a plurality of transversely spaced wheels mounted on said front axle and said rear axle;

drive means supported by said frame for imparting rotation to said front axle and to said rear axle; and a mounting assembly for temporarily attaching said drive unit to a lowermost row of said telescopic seating system, said mounting assembly being detachably mounted to said frame, said mounting assembly comprising:

a. a longitudinal beam;

b. fastening means interconnecting said longitudinal beam and said frame;

c. a spacer spacing said longitudinal beam from said frame; and d. an upright member connected to said longitudinal beam at a lower end and fastened to a row of bleachers proximate an upper end.

* * * * *